US010530099B2

(12) United States Patent
Song et al.

(10) Patent No.: US 10,530,099 B2
(45) Date of Patent: Jan. 7, 2020

(54) BOARD MATING CONNECTOR INCLUDING GROUND UNIT IN WHICH TAPERED PORTION IS FORMED

(71) Applicant: GigaLane Co., Ltd., Hwaseong-si, Gyeonggi-do (KR)

(72) Inventors: Hwa Yoon Song, Hwaseong-si (KR); Jin Uk Lee, Hwaseong-si (KR); Sun Hwa Cha, Hwaseong-si (KR); Chang Hyun Yang, Hwaseong-si (KR); Eun Jung Kim, Hwaseong-si (KR); Kyung Hun Jung, Hwaseong-si (KR); Hee seok Jung, Hwaseong-si (KR)

(73) Assignee: GIGALANE CO., LTD., Hwaseong-si, Gyeonggi-Do (KR)

( * ) Notice: Subject to any disclaimer, the term of this patent is extended or adjusted under 35 U.S.C. 154(b) by 0 days.

(21) Appl. No.: 16/361,442

(22) Filed: Mar. 22, 2019

(65) Prior Publication Data

US 2019/0305485 A1 Oct. 3, 2019

(30) Foreign Application Priority Data

Mar. 27, 2018 (KR) ..... 10-2018-0034835

(51) Int. Cl.
*H01R 13/64* (2006.01)
*H01R 13/6471* (2011.01)
(Continued)

(52) U.S. Cl.
CPC ..... *H01R 13/6471* (2013.01); *H01R 12/714* (2013.01); *H01R 13/17* (2013.01); *H01R 13/2421* (2013.01); *H01R 24/50* (2013.01)

(58) Field of Classification Search
CPC ..... H01R 13/6471
See application file for complete search history.

(56) References Cited

U.S. PATENT DOCUMENTS 7,416,418 B2 * 8/2008 Berthet ..... H01R 24/50 439/63
9,590,345 B2 * 3/2017 Wollitzer ..... H01R 13/2421
2014/0030915 A1 * 1/2014 Perrin ..... H01R 24/50 439/578

FOREIGN PATENT DOCUMENTS

KR 1020130098047 A 9/2013

* cited by examiner

*Primary Examiner* — Ross N Gushi
(74) *Attorney, Agent, or Firm* — Brundidge & Stanger, P.C.

(57) ABSTRACT

In one example, a board mating connection, which includes a ground unit in which a tapered portion is formed, includes: a signal contact unit which has one side in contact with a signal electrode of a board and is electrically connected to the signal electrode; a ground contact unit which has one side in contact with a ground electrode of the board and is electrically connected to the ground electrode; and a dielectric unit which is disposed between the signal contact unit and the ground contact unit, wherein the ground contact unit includes a first ground portion which has a first ground hollow portion and includes a second ground portion of which the other side is partially inserted into the first ground hollow portion and which has a second ground hollow portion, the first ground portion includes a first ground tapered portion formed on a wall thereof so as to have an inclined shape such that an inner diameter thereof is gradually decreased toward the other side thereof, and the second ground portion has the other end in contact with the first ground tapered portion and is relatively moved.

13 Claims, 6 Drawing Sheets

200(210,220)
201(211,221)
300(310,320)

200(210,220,230)
201(211,221)
300(310,320)

(51) Int. Cl.

| | |
|---|---|
| ***H01R 12/71*** | (2011.01) |
| ***H01R 24/50*** | (2011.01) |
| ***H01R 13/17*** | (2006.01) |
| ***H01R 13/24*** | (2006.01) |

200(210,220)
201(211,221)
300(310,320)

BOARD MATING CONNECTOR INCLUDING GROUND UNIT IN WHICH TAPERED PORTION IS FORMED

CROSS-REFERENCE TO RELATED APPLICATION

This application claims the benefit under 35 U.S.C. § 119 of a Korean patent application No. 10-2018-0034835 filed on Mar. 27, 2018 in the Korean Intellectual Property Office, the entire disclosure of which is hereby incorporated herein by reference.

TECHNICAL FIELD

The embodiments relate to a board mating connector including a ground unit in which a tapered portion is formed.

BACKGROUND

As shown in FIG. 1, a board mating connector, which has one side in contact with a board such as a printed circuit board on which a signal wiring is formed and transmits a radio frequency (RF) signal to the board, includes a signal contact unit 100 in contact with a signal electrode of the board and a ground contact unit 200 in contact with a ground electrode of the board <Problems of Ground Contact Unit>

Generally, when the ground contact unit 200 is compressed in a direction opposite to the board, the ground contact unit 200 receives a restoring force to restore the ground contact unit 200 in a direction of the board through a ground spring GS.

The ground spring GS is manufactured by molding a metal wire.

However, the ground spring GS has problems in that, as time goes by, a restoring force thereof is decreased and corrosiveness thereof is increased.

<Problems of Signal Contact Unit>

Generally, the signal contact unit 100 includes a housing 110, a contact portion 120, and a signal spring 130.

The housing 110 and the contact portion 120 are electrically connected through the signal spring 130.

However, when the RF signal is transmitted through the signal spring 130, passive inter-modulation distortion (PIMD) characteristics are degraded.

PRIOR ART DOCUMENTS

Patent Documents (Patent Document 1) JP 4287107 B2
(Patent Document 2) KR 10-2015-0080486 A
(Patent Document 3) KR 10-152937 B1
(Patent Document 4) KR 10-1408249 B1

SUMMARY

The present invention is directed to providing a board mating connector including a ground unit in which a tapered portion is formed.

In one example embodiment, a board mating connector, which includes a ground unit in which a tapered portion is formed, includes a signal contact unit which has one side in contact with a signal electrode of a board and is electrically connected to the signal electrode; a ground contact unit which has one side in contact with a ground electrode of the board and is electrically connected to the ground electrode; and a dielectric unit which is disposed between the signal contact unit and the ground contact unit, wherein the ground contact unit includes a ground portion which includes a tapered portion formed on an inner wall thereof so as to have an inclined shape such that an inner diameter thereof is gradually decreased toward one side or the other side thereof, and another ground portion which has one end or the other end in contact with the tapered portion and is relatively moved.

The ground contact unit may include a first ground portion having a first ground hollow portion and a second ground portion of which the other side is partially inserted into the first ground hollow portion and which has a second ground hollow portion. The tapered portion may include a first ground tapered portion which is formed in an inclined shape such that an inner diameter thereof is gradually decreased toward the other side thereof on an inner wall of the first ground portion.

The second ground portion may further include a first protrusion which protrudes outward from the other end of the second ground portion and further include two or more first slits which are elongated to one side of the second ground portion from the other end thereof along a circumference of the second ground portion, wherein, when the second ground portion is moved in a direction of the first ground portion, an outer diameter of the first protrusion is compressed by the first ground tapered portion, and the compressed outer diameter of the first protrusion is restored in a direction in which an inner diameter of the first ground tapered portion is increased so that the second ground portion is moved in a direction opposite to the direction of the first ground portion.

The dielectric unit may include a first dielectric portion disposed between the first ground portion and the signal contact unit and include a second dielectric portion which is disposed between the second ground portion and the signal contact unit, wherein a second dielectric hollow portion having a diameter greater than that of the signal contact unit is formed in the second dielectric portion so that the second dielectric portion is in surface contact with the second ground portion and is not in surface contact with the signal contact unit.

The ground contact unit may further include a third ground portion which has a third ground hollow portion and in which one side of the second ground portion is partially inserted into the third ground hollow portion, wherein the third ground portion includes a third ground tapered portion which is formed on an inner wall of the third ground portion so as to have an inclined shape such that an inner diameter thereof is gradually decreased toward one side thereof.

The second ground portion may include a second protrusion protruding outward from the other end of the second ground portion and include two or more second slits which are elongated from one end of the second ground portion to the other side thereof along the circumference of the second ground portion, wherein, when the third ground portion is moved in a direction of the second ground portion, an outer diameter of the second protrusion is compressed by the third ground tapered portion, and the compressed outer diameter of the second protrusion is restored in a direction in which an inner diameter of the third ground tapered portion is increased so that the third ground portion is moved in a direction opposite to the direction of the second ground portion.

The first ground portion may further include a first ground latch portion which protrudes inward from a wall of the first ground portion at one side of the first ground portion with respect to a position where the first ground tapered portion is formed, and the third ground portion may further include a third ground latch portion which protrudes inward from a wall of the third ground portion at the other side of the third ground portion with respect to a position where the third ground tapered portion is formed.

The dielectric unit may be disposed between the first ground portion and the signal contact unit, may extend in a direction of the second ground portion so as to not be in contact with the second ground portion, and may be inserted into the second ground hollow portion. The signal contact unit may include a housing which has a housing insertion hole of which one side is open, a contact portion which has a contact portion insertion hole of which the other side is open, and a signal spring which is inserted between the one side of the housing insertion hole and the other side of the contact portion insertion hole, wherein one side of the housing is partially inserted into the contact portion insertion hole, and in a state in which the signal spring is compressed, an inner side of the contact portion comes into contact with an outer side of the housing so that the housing and the contact portion are electrically connected.

The contact portion may include a contact portion protrusion protruding from an inner wall of the other end of the contact portion and include two or more contact portion slits which are elongated to one side of the contact portion from the other end thereof along a circumference of the contact portion.

In a state in which the signal spring is restored, the contact portion protrusion may be inserted into a housing groove formed in a ring shape along a circumference of the housing. The signal contact unit may include a housing which has a housing insertion hole of which one side is open, a contact portion of which the other side is partially inserted into the housing insertion hole, and a signal spring which is inserted between the one side of the housing insertion hole and the other side of the contact portion, wherein, in a state in which the signal spring is compressed, an outer side of the contact portion comes into contact with an inner side of the housing so that the housing and the contact portion are electrically connected.

The housing may include a housing protrusion protruding from an inner wall of one end of the housing and include two or more housing slits which are elongated from the one end of the housing to the other side thereof along a circumference of the housing.

In a state in which the signal spring is restored, the housing protrusion may be inserted into a contact portion groove formed in a ring shape along a circumference of the contact portion.

BRIEF DESCRIPTION OF THE DRAWINGS

In the detailed description that follows, embodiments are described as illustrations only since various changes and modifications will become apparent to those skilled in the art from the following detailed description. The use of the same reference numbers in different figures indicates similar or identical items.

DETAILED DESCRIPTION

A ground spring GS has problems in that, as time goes by, a restoring force thereof is decreased and corrosion thereof is increased.

Figure 1:
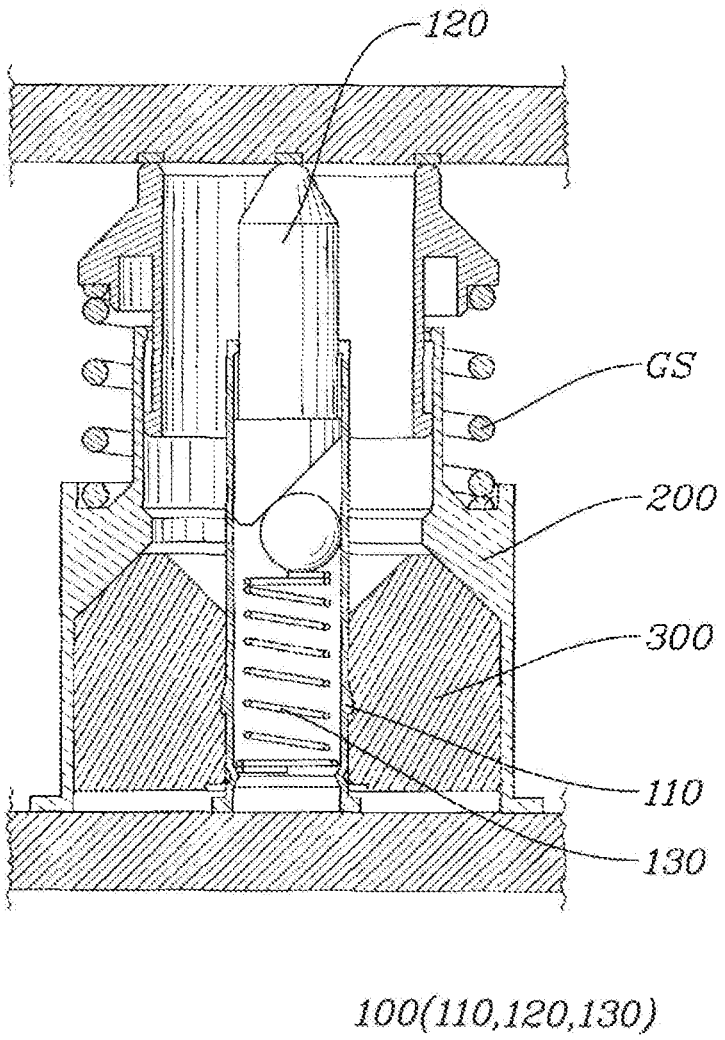
PRIOR ART FIG. 1
FIG. 1 is a cross-sectional view illustrating the related art.
Figure 2:
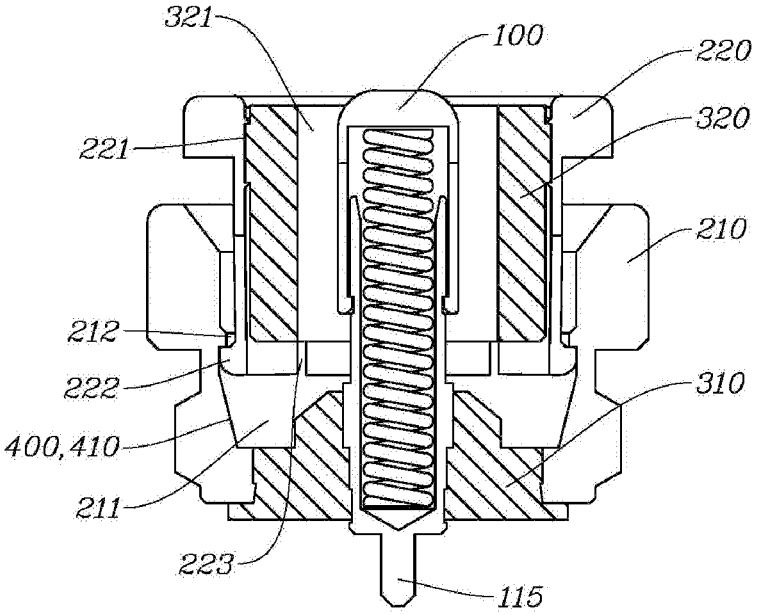
FIG. 2 is a cross-sectional view illustrating a restoration state of a board mating connector.

In order to solve the problems, as shown in FIG. 2, a board mating connector according to the present invention includes a signal contact unit 100, a ground contact unit 200, and a dielectric unit 300.

One side of the signal contact unit 100 comes into contact with a signal electrode of a board, and thus, the signal contact unit 100 is electrically connected to the signal electrode.

One side of the ground contact unit 200 comes into contact with a ground electrode of the board, and thus, the ground contact unit 200 is electrically connected to the ground electrode.

The dielectric unit 300 is disposed between the signal contact unit 100 and the ground contact unit 200.

In this case, the ground contact unit 200 includes a tapered portion 400 formed in an inclined shape such that an inner diameter thereof is gradually decreased toward one side or the other side thereof on an inner wall of the ground contact unit 200.

As a detailed configuration of the tapered portion 400, the tapered portion 400 includes a first ground tapered portion 410.

In addition, the ground contact unit 200 includes a first ground portion 210 and a second ground portion 220.

First, describing the components of the tapered portion 400, the first ground tapered portion 410 is formed in an inclined shape such that an inner diameter thereof is gradually decreased toward the other side thereof on an inner wall of the first ground portion 210. Next, describing components of the ground contact unit 200, a first ground hollow portion 211 is formed in the first ground portion 210.

The other side of the second ground portion 220 is partially inserted into the first ground hollow portion 211, and a second ground hollow portion 221 is formed in the second ground portion 220.

In addition, the second ground portion 220 further includes a first protrusion 222 and a first slit 223.

The first protrusion 222 protrudes outward from the other end of the second ground portion 220.

The first slit 223 is elongated to one side of the second ground portion 220 from the other end thereof. Two or more first slits 223 are formed along a circumference of the second ground portion 220 such that the other end of the second ground portion 220 is divided into a plurality of portions.

When the second ground portion 220 is moved in the direction of the first ground portion 210, an outer diameter of the first protrusion 222 is compressed by the first ground tapered portion 410, and the compressed outer diameter of the first protrusion 222 is restored in a direction in which an inner diameter of the first ground tapered portion 410 is increased. Thus, the second ground portion 220 is moved in a direction opposite to the direction of the first ground portion 210.

In this case, in order to prevent the second ground portion 220 from being moved more than necessary in the direction opposite to the direction of the first ground portion 210, a first ground latch portion 212 may be formed to protrude inward from a wall of the first ground portion 210 at one side of the wall of the first ground portion 210 with respect to a position where the first ground tapered portion 410 is formed.

One side of the first protrusion 222 may be caught by the first ground latch portion 212, and thus, the first ground latch portion 212 may prevent the second ground portion 220 from being further moved in the direction opposite to the direction of the first ground portion 210.

As described above, the first ground tapered portion 410, the first protrusion 222, and the first slit 223 replace the ground spring GS.

Therefore, since the ground spring GS is not provided, problems caused by the ground spring GS being provided do not occur.

As shown in FIG. 2, the dielectric unit 300 includes a first dielectric portion 310 and a second dielectric portion 320.

The first dielectric portion 310 is disposed between the first ground portion 210 and the signal contact unit 100.

The second dielectric portion 320 is disposed between the second ground portion 220 and the signal contact unit 100.

When the second ground portion 220 is moved in the direction of the first ground portion 210 and the second dielectric portion 320 approaches the first dielectric portion 310, in order to minimize a change in impedance, which is caused by a dielectric constant of the second dielectric portion 320 being added to a dielectric constant of the first dielectric portion 310, a second dielectric hollow portion 321 having a diameter greater than that of the signal contact unit 100 may be formed in the second dielectric portion 320. Accordingly, the second dielectric portion 320 may be in surface contact with the second ground portion 220 and may not be in surface contact with the signal contact unit 100.

Therefore, it is possible to minimize the change in impedance.

Figure 3:
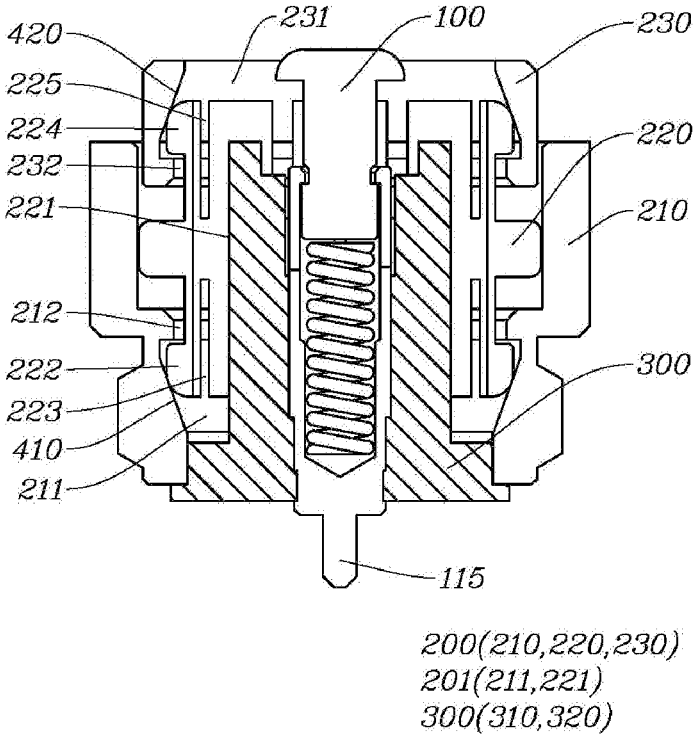
FIG. 3 is a cross-sectional view illustrating a compression state of the board mating connector.

As shown in FIG. 3, when the ground contact unit 200 is compressed in a direction opposite to the board, in order to further increase a restoring force to restore the ground contact unit 200 in the direction of the board, the ground contact unit 200 may further include a third ground portion 230 in which a third ground tapered portion 420 is formed, and the second ground portion 220 may further include a second protrusion 224 and a second slit 225.

A third ground hollow portion 231 is formed in the third ground portion 230, and one side of the second ground portion 220 is partially inserted into the third ground hollow portion 231. The third ground tapered portion 420 is formed in an inclined shape such that an inner diameter thereof is gradually decreased toward one side thereof on an inner wall of the third ground portion 230.

The second protrusion 224 protrudes outward from one end of the second ground portion 220.

The second slit 225 is elongated from one end of the second ground portion 220 to the other side thereof. Two or more second slits 225 are formed along the circumference of the second ground portion 220 such that one end of the second ground portion 220 is divided into a plurality of portions.

When the third ground portion 230 is moved in the direction of the second ground portion 220, an outer diameter of the second protrusion 224 is compressed by the third ground tapered portion 420, and the compressed outer diameter of the second protrusion 224 is restored in a direction in which an inner diameter of the third ground tapered portion 420 is increased. Thus, the third ground portion 230 is moved in a direction opposite to the direction of the second ground portion 220.

In this case, in order to prevent the third ground portion 230 from being moved more than necessary in the direction opposite to the direction of the second ground portion 220, a third ground latch portion 232 may be formed to protrude inward from a wall of the third ground portion 230 at the other side of the wall of the third ground portion 230 with respect to a position where the third ground tapered portion 420 is formed.

One side of the second protrusion 224 may be caught by the third ground latch portion 232, and thus, the third ground latch portion 232 may prevent the third ground portion 230 from being further moved in the direction opposite to the direction of the second ground portion 220.

As shown in FIG. 3, the dielectric unit 300 may be disposed between the first ground portion 210 and the signal contact unit 100. The dielectric unit 300 may extend in the direction of the second ground portion 220 so as to not be in contact with the second ground portion 220 and may be inserted into the second ground hollow portion 221.

When the housing 110 and the contact portion 120 are electrically connected through the signal spring 130, there is a problem in that passive inter-modulation distortion (PIMD) characteristics are degraded.

Figure 4:
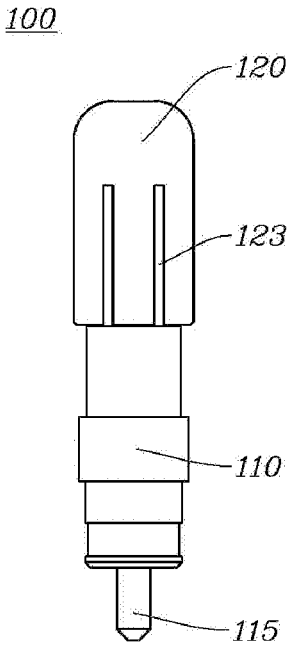
FIG. 4 is a view illustrating an exterior of a signal contact unit according to a first embodiment.
Figure 5:
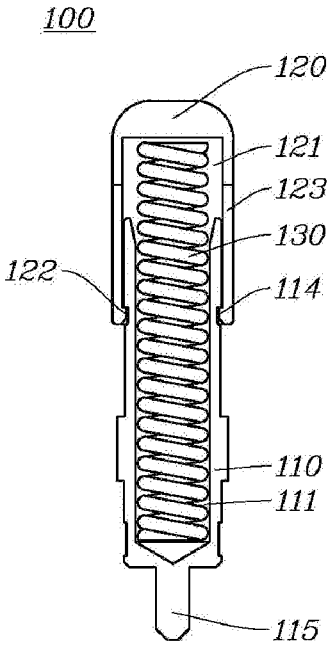
FIG. 5 is a cross-sectional view illustrating a restoration state of the signal contact unit according to the first embodiment.
Figure 6:
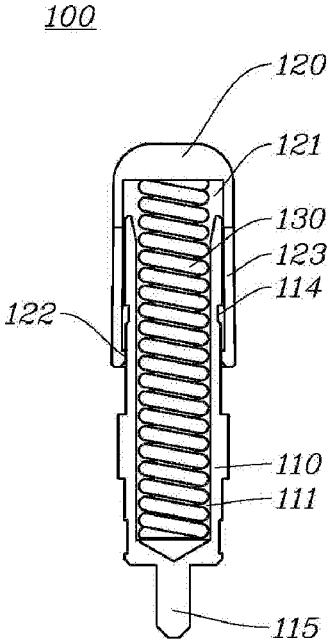
FIG. 6 is a cross-sectional view illustrating a compression state of the signal contact unit according to the first embodiment.

In order to solve the problem, as shown in FIGS. 4 to 6, a signal contact unit 100 according to a first embodiment includes a housing 110, a contact portion 120, and a signal spring 130. The housing 110 has a housing insertion hole 111 of which one side is open and includes a contact pin 115 formed at the other end thereof.

The contact portion 120 has a contact portion insertion hole 121 of which the other side is open.

The signal spring 130 is inserted between one side of the housing insertion hole 111 and the other side of the contact portion insertion hole 121.

One side of the housing 110 is partially inserted into the contact portion insertion hole 121. As shown in FIG. 6, in a state in which one side of the contact portion 120 comes into contact with a board and the signal spring 130 is compressed, an inner side of the contact portion 120 comes into contact with an outer side of the housing 110, and thus, the housing 110 and the contact portion 120 are electrically connected.

The contact portion 120 includes a contact portion protrusion 122 and a contact portion slit 123 such that the inner side of the contact portion 120 stably comes into contact with the outer side of the housing 110.

The contact portion protrusion 122 is formed to protrude from an inner wall of the other end of the contact portion 120.

The contact portion slit 123 is elongated to one side of the contact portion 120 from the other end thereof. Two or more contact portion slits 123 are formed along a circumference of the contact portion 120 such that the other end of the contact portion 120 is divided into a plurality of portions.

As shown in FIG. 6, in a state in which one side of the contact portion 120 comes into contact with the board and the signal spring 130 is compressed, an inner diameter of the other end of the contact portion 120 is increased by the contact portion slit 123, and the contact portion protrusion 122 stably comes into contact with the outer side of the housing 110 due to a restoring force of the other end of the contact portion 120 having the increased inner diameter.

In this case, in order to improve the stable contact, in a state in which the signal spring 130 is compressed, the inner diameter of the contact portion protrusion 122 may be smaller than an outer diameter of the housing 110 with which the contact portion protrusion 122 comes into contact.

In addition, in order to prevent the restoring force from being damaged due to a state, in which the inner diameter of the other end of the contact portion 120 is increased, being maintained, as shown in FIG. 5, in a state in which the signal spring 130 is restored, the contact portion protrusion 122 may be inserted into a housing groove 114 formed in a ring shape along a circumference of the housing 110.

Although not shown, in order for the signal spring 130 to not be electrically connected to the contact portion 120, a ball-shaped dielectric (not shown) may be disposed between the contact portion 120 and the signal spring 130, and thus, the housing 110 and the contact portion 120 may be electrically connected to each other only by a contact between the outer side of the housing 110 and the inner side of the contact portion 120.

In addition, one end of the contact portion 120 may be formed to have a groove or protrusion to increase a contact force with the board.

Figure 7:
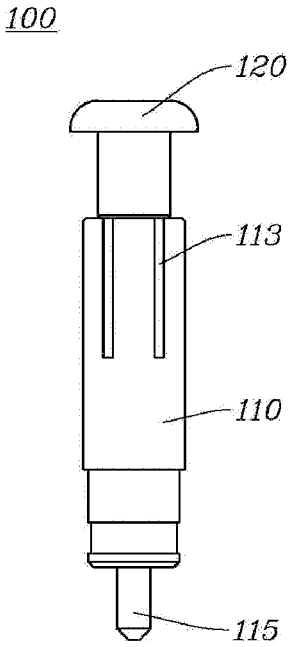
FIG. 7 is a view illustrating an exterior according to of a signal contact unit a second embodiment.
Figure 8:
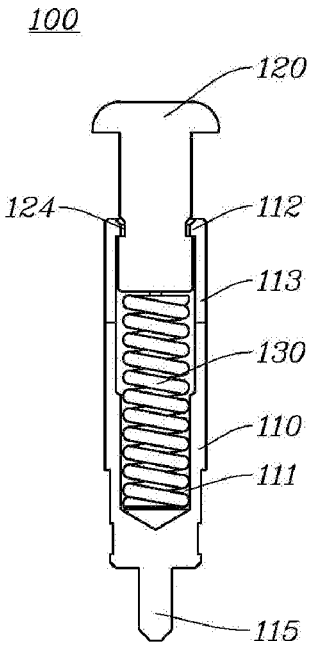
FIG. 8 is a cross-sectional view illustrating a restoration state of the signal contact unit according to the second embodiment.
Figure 9:
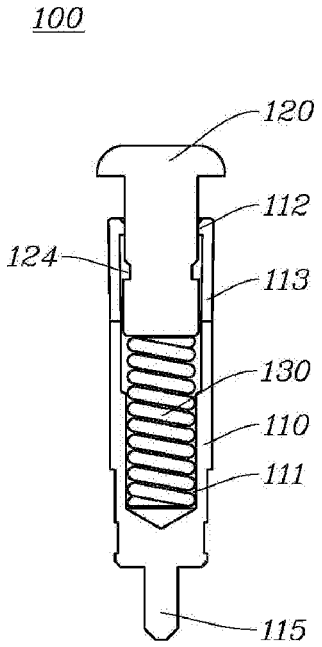
FIG. 9 is a cross-sectional view illustrating a compression state of the signal contact unit according to the second embodiment.

As described above, since the housing 110 and the contact portion 120 are electrically connected, the signal contact unit 100 has an effect of ameliorating PIMD characteristics. As shown in FIGS. 7 to 9, a second embodiment of a signal contact unit 100 includes a housing 110, a contact portion 120, and a signal spring 130.

The housing 110 has a housing insertion hole 111 of which one side is open and includes a contact pin 115 formed at the other end thereof.

The other side of the contact portion 120 is partially inserted into the housing insertion hole 111.

The signal spring 130 is inserted between one side of the housing insertion hole 111 and the other side of the contact portion 120.

As shown in FIG. 9, in a state in which one side of the contact portion 120 comes into contact with a board and the signal spring 130 is compressed, an outer side of the contact portion 120 comes into contact with an inner side of the housing 110, and thus, the housing 110 and the contact portion 120 are electrically connected.

The housing 110 includes a housing protrusion 112 and a housing slit 113 such that the outer side of the contact portion 120 stably comes into contact with the inner side of the housing 110.

The housing protrusion 112 protrudes from an inner wall of one end of the housing 110.

The housing slit 113 is elongated from one end of the housing 110 to the other side thereof. Two or more housing slits 113 are formed along a circumference of the housing 110 such that one end of the housing 110 is divided into a plurality of portions.

In this case, in order to improve the stable contact, in a state in which the signal spring 130 is compressed, an inner diameter of the housing protrusion 112 may be smaller than an outer diameter of the contact portion 120 with which the housing protrusion 112 comes into contact.

In addition, in order to prevent a restoring force from being damaged due to a state, in which an inner diameter of the one end of the housing 110 is increased, being maintained, as shown in FIG. 8, in a state in which the signal spring 130 is restored, the housing protrusion 112 may be inserted into a contact portion groove 124 formed in a ring shape along a circumference of the contact portion 120.

Although not shown, in order for the signal spring 130 to not be electrically connected to the contact portion 120, a ball-shaped dielectric may be disposed between the contact portion 120 and the signal spring 130, and thus, the housing 110 and the contact portion 120 may be electrically connected only by a contact between the outer side of the housing 110 and the inner side of the contact portion 120.

In addition, one end of the contact portion 120 may be formed to have a groove or protrusion to increase a contact force with the board.

As described above, since the housing 110 and the contact portion 120 are electrically connected, the signal contact unit 100 has an effect of ameliorating PIMD characteristics. First, since a ground spring is not provided, problems caused by the ground spring GS being provided do not occur.

In addition, a change in impedance is minimized.

Furthermore, PIMD characteristics are ameliorated.

DESCRIPTION OF REFERENCE NUMERALS

| | |
|---|---|
| 100: signal contact unit | 110: housing |
| 111: housing insertion hole | 112: housing protrusion |
| 113: housing slit | 114: housing groove |
| 115: contact pin | 120: contact portion |
| 121: contact portion insertion hole | 122: contact portion protrusion |
| 123: contact portion slit | 124: contact portion groove |
| 130: signal spring | 200: ground contact unit |
| 210: first ground portion | 211: first ground hollow portion |
| 212: first ground latch portion | 220: second ground portion |
| 221: second ground hollow portion | 222: first protrusion |
| 223: first slit | 224: second protrusion |
| 225: second slit | 230: third ground portion |
| 231: third ground hollow portion | 232: third ground latch portion |
| 300: dielectric unit | 310: first dielectric portion |
| 320: second dielectric portion | 400: tapered portion |
| 410: first ground tapered portion | 420: third ground tapered portion |
| GS: ground spring | |

We claim:

1. A board mating connector which includes a ground unit in which a tapered portion is formed, the board mating conductor comprising:

a signal contact unit which has one side in contact with a signal electrode of a board and is electrically connected to the signal electrode;

a ground contact unit which has one side in contact with a ground electrode of the board and is electrically connected to the ground electrode; and a dielectric unit which is disposed between the signal contact unit and the ground contact unit, wherein the ground contact unit includes:

a first ground portion having a first ground hollow portion, and a second ground portion of which one end is partially inserted into the first ground hollow portion and having a second ground hollow portion, wherein the first ground portion includes a first ground tapered portion formed on an inner wall thereof so as to have an inclined shape such that an inner diameter thereof is gradually decreased toward one side thereof, wherein the one end of the second ground portion is configured to be in contact with the first ground tapered portion and is relatively moved, wherein, when the second ground portion is moved in a direction of the first ground portion, the one end of the second ground portion is compressed by the first ground tapered portion, and the compressed one end of the second ground portion is restored in a direction in which an inner diameter of the first ground tapered portion is increased so that the second ground portion is moved in a direction opposite to the direction of the first ground portion, wherein the second ground portion includes a first protrusion which protrudes outward from the one end of the second ground portion, and the first ground portion further includes a first ground latch portion which protrudes inward from a wall of the first ground portion at another side of the first ground portion with respect to a position where the first ground tapered portion is formed, and wherein the first protrusion is configured to be caught by the first ground latch portion.

2. The board mating connector of claim 1, wherein the second ground portion further includes two or more first slits which are elongated to another end of the second ground portion from the one end thereof and formed along a circumference of the second ground portion, and wherein, when the second ground portion is moved in the direction of the first ground portion, an outer diameter of the first protrusion is compressed by the first ground tapered portion, and the compressed outer diameter of the first protrusion is restored in the direction in which the inner diameter of the first ground tapered portion is increased so that the second ground portion is moved in the direction opposite to the direction of the first ground portion.

3. The board mating connector of claim 2, wherein the dielectric unit includes:

a first dielectric portion which is disposed between the first ground portion and the signal contact unit; and a second dielectric portion which is disposed between the second ground portion and the signal contact unit, wherein a second dielectric hollow portion having a diameter greater than that of the signal contact unit is formed in the second dielectric portion so that the second dielectric portion is in surface contact with the second ground portion and is not in surface contact with the signal contact unit.

4. The board mating connector of claim 2, wherein the ground contact unit further includes a third ground portion which has a third ground hollow portion and in which the another end of the second ground portion is partially inserted into the third ground hollow portion, wherein the third ground portion includes a third ground tapered portion which is formed on an inner wall of the third ground portion so as to have an inclined shape such that an inner diameter thereof is gradually decreased toward one side thereof.

5. The board mating connector of claim 4, wherein the second ground portion includes:

a second protrusion which protrudes outward from the another end of the second ground portion; and two or more second slits which are elongated from the another end of the second ground portion to the one end thereof and formed along the circumference of the second ground portion, wherein, when the third ground portion is moved in a direction of the second ground portion, an outer diameter of the second protrusion is compressed by the third ground tapered portion, and the compressed outer diameter of the second protrusion is restored in a direction in which an inner diameter of the third ground tapered portion is increased so that the third ground portion is moved in a direction opposite to the direction of the second ground portion.

6. The board mating connector of claim 4, wherein the third ground portion further includes a third ground latch portion which protrudes inward from a wall of the third ground portion at another side of the third ground portion with respect to a position where the third ground tapered portion is formed.

7. The board mating connector of claim 4, wherein the dielectric unit is disposed between the first ground portion and the signal contact unit, extends in a direction of the second ground portion so as to not be in contact with the second ground portion, and is inserted into the second ground hollow portion.

8. The board mating connector of claim 1, wherein the signal contact unit includes:

a housing which has a housing insertion hole of which one end is open;

a contact portion which has a contact portion insertion hole of which one end is open; and a signal spring which is inserted between the one end of the housing insertion hole and the one end of the contact portion insertion hole, wherein one end of the housing is partially inserted into the contact portion insertion hole, and in a state in which the signal spring is compressed, an inner side of the contact portion comes into contact with an outer side of the housing so that the housing and the contact portion are electrically connected.

9. The board mating connector of claim 8, wherein the contact portion includes:

a contact portion protrusion which protrudes from an inner wall of one end of the contact portion; and two or more contact portion slits which are elongated to another end of the contact portion from the one end thereof and formed along a circumference of the contact portion.

10. The board mating connector of claim 9, wherein, in a state in which the signal spring is restored, the contact portion protrusion is inserted into a housing groove formed in a ring shape along a circumference of the housing.

11. The board mating connector of claim 1, wherein the signal contact unit includes:

a housing which has a housing insertion hole of which one end is open;

a contact portion of which one end is partially inserted into the housing insertion hole; and a signal spring which is inserted between the one end of the housing insertion hole and the one end of the contact portion, wherein, in a state in which the signal spring is compressed, an outer side of the contact portion comes into contact with an inner side of the housing so that the housing and the contact portion are electrically connected.

12. The board mating connector of claim 11, wherein the housing includes:

a housing protrusion which protrudes from an inner wall of one end of the housing; and two or more housing slits which are elongated from the one end of the housing to another end thereof and formed along a circumference of the housing.

13. The board mating connector of claim 12, wherein, in a state in which the signal spring is restored, the housing protrusion is inserted into a contact portion groove formed in a ring shape along a circumference of the contact portion.

* * * * *